US006848848B2

(12) United States Patent
Terao

(10) Patent No.: US 6,848,848 B2
(45) Date of Patent: Feb. 1, 2005

(54) METHOD OF FEEDING RECORDING SHEET, AND IMAGE RECORDING APPARATUS

(75) Inventor: Yasunobu Terao, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/243,138

(22) Filed: Sep. 12, 2002

(65) Prior Publication Data

US 2004/0051237 A1 Mar. 18, 2004

(51) Int. Cl.[7] ..... B41J 13/00; B41J 13/03; B65H 5/24

(52) U.S. Cl. ..... 400/624; 400/625; 400/629

(58) Field of Search ..... 400/624, 625, 400/629; 347/104; 271/23

(56) References Cited

U.S. PATENT DOCUMENTS 6,629,795 B2 * 10/2003 Kinoshita et al. ..... 400/582

FOREIGN PATENT DOCUMENTS

| | | | | |
|---|---|---|---|---|
| JP | 05238590 A | * | 9/1993 | ..... B65H/5/24 |
| JP | 06056299 A | * | 3/1994 | ..... B65H/5/06 |
| JP | 07069465 A | * | 3/1995 | ..... B65H/1/28 |
| JP | 2000-95379 A | | 4/2000 | |
| JP | 2001287848 A | * | 10/2001 | ..... B65H/5/24 |

OTHER PUBLICATIONS

Machine translation of JP 2001287848 to Fujiwara from Japanese Patent Office website.*
Machine translation of JP 07069465 to Kosugi et al. from Japanese Patent Office website.*
Machine translation of JP 06056299 to Yamanaka et al. from Japanese Patent Office website.*

* cited by examiner

*Primary Examiner*—Daniel J. Colilla
(74) *Attorney, Agent, or Firm*—Frishauf, Holtz, Goodman & Chick, P.C.

(57) ABSTRACT

N recording sheets are carried in a superimposed state with the image recording surface side of each recording sheet being displaced by a distance corresponding to each of the lengths $Z_1$, $Z_2$, . . . , $Z_n$ from each end, and an image is recorded on the image recording surface of each of the n recording sheets carried in the superimposed state within a range of each of the lengths $Z_1$, $Z_2$, . . . , $Z_n$ from each end.

7 Claims, 8 Drawing Sheets

METHOD OF FEEDING RECORDING SHEET, AND IMAGE RECORDING APPARATUS

BACKGROUND OF THE INVENTION

1. Field of the Invention

The present invention relates to a method of feeding a recording sheet and an image recording apparatus.

2. Description of the Related Art

A method of feeding a recording sheet, which efficiently carries the recording sheet to be used in image recording and improves throughput, is disclosed in Jpn. Pat. Appln. KOKAI Publication No. 2000-95379. In the feeding method disclosed in this laid-open publication, when print data continues to the next page, pages are overlapped in such a manner that the front end section of the next page in the feeding direction gets under the rear end section of the previous page in the feeding direction.

The recording sheets are fed, each overlapping another, only if the print data continues to the next page. In other words, the sheets being fed never overlap if the print data does not continue to the next page. Hence, the throughput of feeding the recording sheets cannot be sufficiently enhanced. If the sheets being fed overlap but a little, the throughput of feeding the sheets cannot be adequately increased, either.

Therefore, sufficient improvement in the throughput of feeding the recording sheets has been demanded.

BRIEF SUMMARY OF THE INVENTION

According to an aspect of the invention, n recording sheets are overlapped and fed in such a manner that image recording surface sides of the respective recording sheets are displaced by lengths $Z_1, Z_2, \ldots Z_n$ from their end sections, and images are recorded on the image recording surfaces of the n recording sheets within a range of the lengths $Z_1, Z_2, \ldots, Z_n$ from the respective end sections in the overlapped and fed state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A preferred embodiment according to the present invention will now be described in detail hereinafter with reference to the accompanying drawings.

Figure 1:
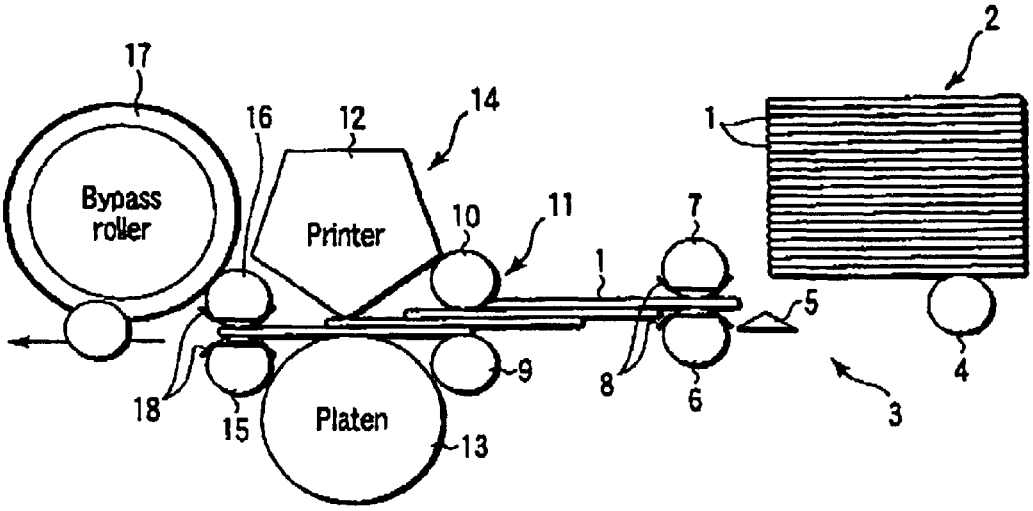
FIG. 1 is a structural view of a primary part of an image recording apparatus showing an embodiment according to the present invention.

As shown in FIG. 1, an image recording apparatus includes an accommodation section 2. The accommodation section 2 superimposes and accommodates therein a plurality of recording sheets 1 with image recording surfaces facing up. A feed-out mechanism 3 is arranged under the accommodation section 2.

The feed-out mechanism 3 provides a feed-out roller 4. The feed-out roller 4 contacts the lower surface side of the lowermost recording sheet 1 which is a non-image-recording surface of the lowermost recording sheet 1, and feeds out the lowermost recording sheet 1 to the left side in the drawing by rotation. The feed-out roller 4 is in contact with the lowermost recording sheet 1 on the side opposite to the feed-out side of the recording sheet 1.

Further, the feed-out mechanism 3 provides a sensor 5 which detects an end section of the recording sheet 1 on the feed-out side of the recording sheet 1.

Furthermore, the feed-out mechanism 3 provides a control roller 6 and an idle roller 7 arranged so as to be opposed to the control roller 6. The control roller 6 feeds out a plurality of the recording sheets 1 in the overlapped manner and controls the displacement from the previous recording sheet 1.

Moreover, the feed-out mechanism 3 provides a change-over section 8. The change-over section 8 changes between overlap of the recording sheet 1 which is subsequently fed out on the precedently fed-out recording sheet 1 and overlap of the recording sheet 1 which is subsequently fed out under the precedently fed-out recording sheet 1.

The feed-out mechanism 3 feeds the recording sheets 1 from the lowermost sheet in order by rotation of the feed-out roller 4, adjusts the displacement from the precedently fed-out recording sheet 1 by controlling rotation of the control roller 6 while detecting an end section of the recording sheet 1 by the sensor 5, and also changes the direction of the recording sheet 1 to be fed out by the change-over section 8.

Figure 3:
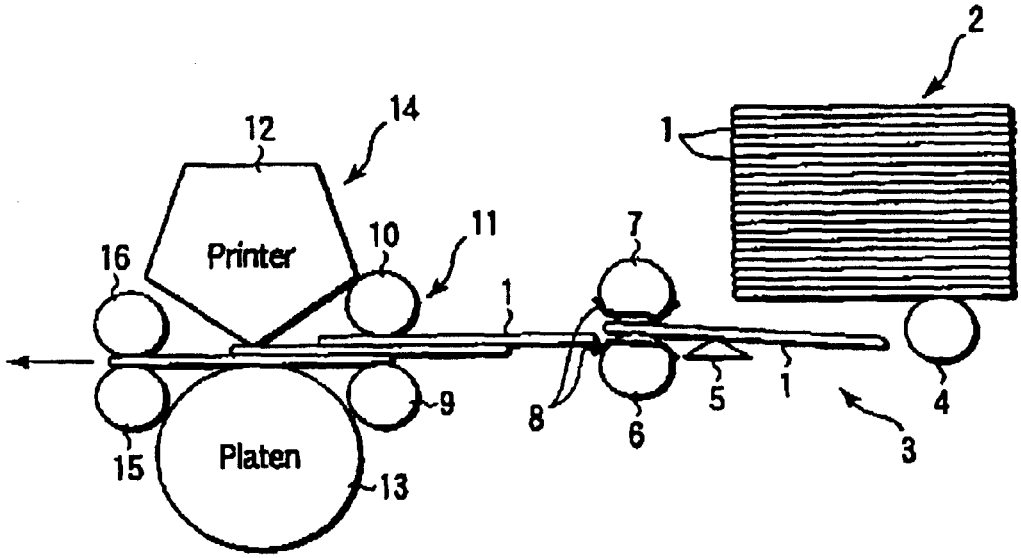
FIG. 3 is a view showing the relationship between the operation of a change-over section and the overlapped state of recording sheets in the embodiment.

As shown in FIG. 3, when the change-over section 8 is changed so as to face upward, a plurality of the recording sheets 1 are overlapped and fed out in such a manner that the image recording surface side of each recording sheet 1 is displaced from the end of the precedently fed-out recording sheet 1 by a predetermined length.

Figure 4:
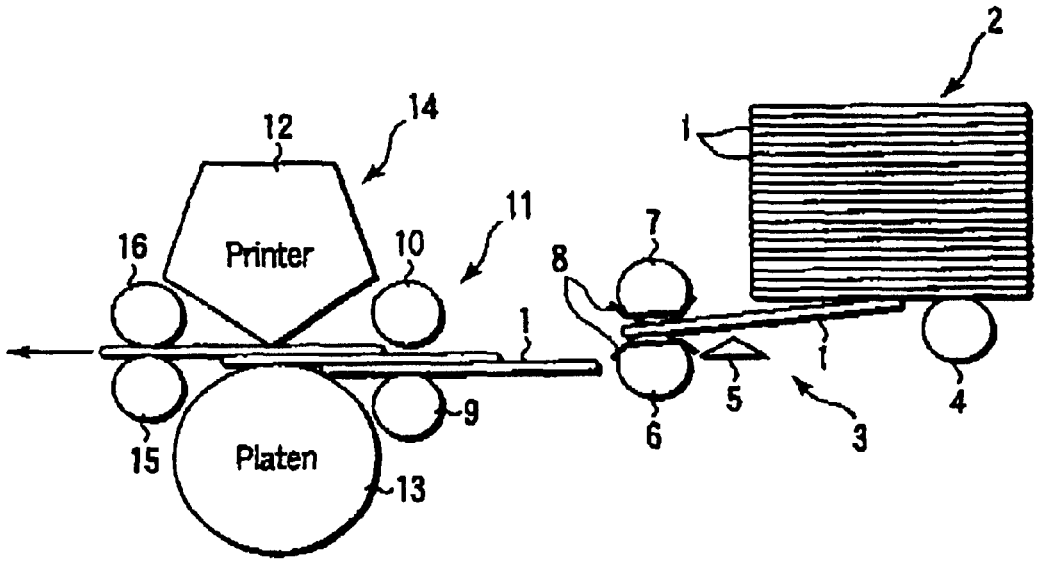
FIG. 4 is a view showing the relationship between the operation of a change-over section and the overlapped state of the recording sheets in this embodiment.

In addition, as shown in FIG. 4, when the change-over section 8 is changed so as to face downward, a plurality of the recording sheets 1 are overlapped and fed out in such a manner that the surface of each recording sheet 1 opposite to the image recording surface thereof is displaced from the end of the precedently fed-out recording sheet 1 by a predetermined length.

A plurality of the recording sheets 1 fed out by the feed-out mechanism 3 are carried to an image recording section 14 consisting of a printer 12 and a platen 13 arranged so as to be opposed to the printer 12 by a carrying section 11 consisting of a feed roller 9 and an idle roller 10.

The image recording section 14 records an image on the recording sheet 1 carried by the printer 12. When a plurality of the recording sheets 1 are carried in the overlapped manner, the printer 12 records an image at a determined position on each recording sheet 1.

The recording sheet 1 having an image recorded thereon by the printer 12 is carried in an ejection direction, as indicated by an arrow in the drawing, by an ejection roller 15 and an idle roller 16. Then, when a plurality of the recording sheets 1 which are carried in the overlapped manner are carried, they pass through a bypass roller 17 along the way if necessary.

The bypass roller 17 constitutes a change section which changes the overlapped state of a plurality of the recording sheets 1 to be ejected in the order of image recording by the image recording section 14. A path change-over section 18 is provided to the ejection roller 15 and the idle roller 16.

The path change-over section 18 feeds the following recording sheet 1 which overlaps the lower surface side of the preceding recording sheet 1 to the bypass roller 17 by changing the direction upward in the drawing. The bypass roller 17 causes the fed recording sheet 1 to bypass and delays the carrying timing. As a result, the recording sheet 1 which has bypassed by the bypass roller 17 overlaps the preceding recording sheet 1.

Figure 2:
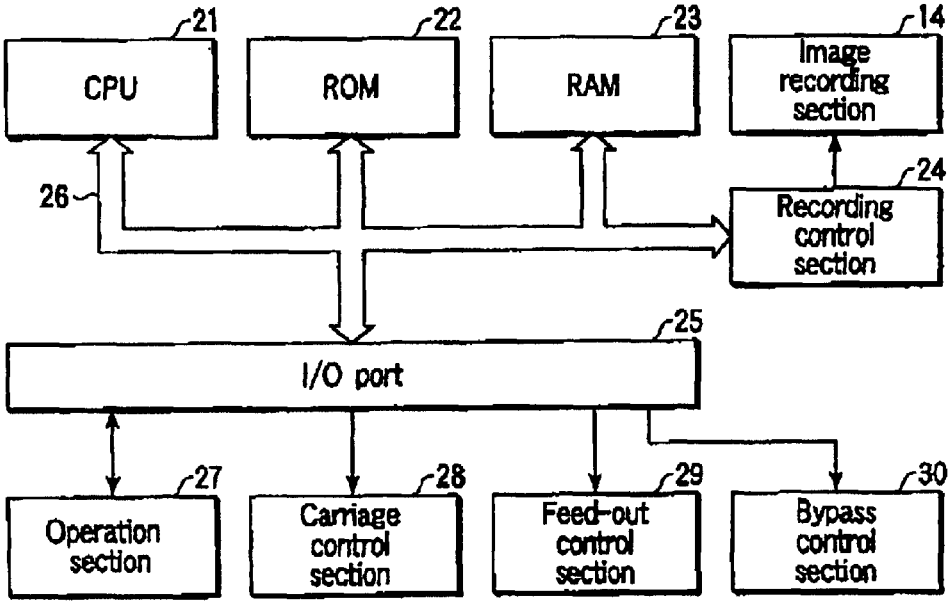
FIG. 2 is a block diagram showing a structure of a control section in this embodiment.

As shown in FIG. 2, the control section of the image recording apparatus includes a CPU (central processing unit) 21 constituting the control section main body, a ROM (read only memory) 22 which stores therein a program or the like used to control each part by the CPU 21, and a RAM (random access memory) 23 including a memory, a work memory or the like used to store data such as image recording data. Additionally, the control section includes a recording control section 24 which drives and controls the image recording section 14, and an I/O port 25.

Further, the CPU 21, the ROM 22, the RAM 23, the recording control section 24 and the I/O port 25 are electrically connected through a bus line 26.

The I/O port 25 controls input/output of data or signals, and connects an operation section 27 having a keyboard or a display provided thereto, a carriage control section 28 which drives and controls the feed roller 9 or the ejection roller 15, a feed-out control section 29 which drives and controls the feed-out roller 4 and the control roller 6, and a bypass control section 30 which drives and controls the bypass path roller 17 and the path change-over section 18.

Figure 5:
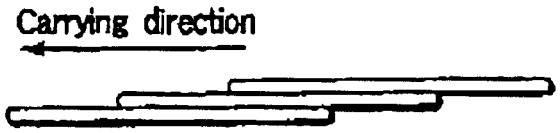
FIG. 5 is a view showing an example of overlap feeding of image recording sheets in the embodiment.

In order to sequentially overlap and carry the recording sheets 1 fed out by rotation of the feed-out roller 4 as shown in FIG. 5, the change-over section 8 is used to change the direction of the recording sheet 1 to be fed upward. Furthermore, control over the displacement from the end by the control roller 6 is determined by the length from the end of an area in which an image is recorded.

That is, when trying to record images on n recording sheets 1 to each of distances $PT_1$, $PT_2$, . . . , $PT_n$ from the respective end sections, the displacement between the precedent recording sheet 1 and the following recording sheet 1 corresponds to each of the distances $Z_1$ ($>PT_1$), $Z_2$ ($>PT_2$), . . . $Z_n$ ($>PT_n$).

Figure 6:
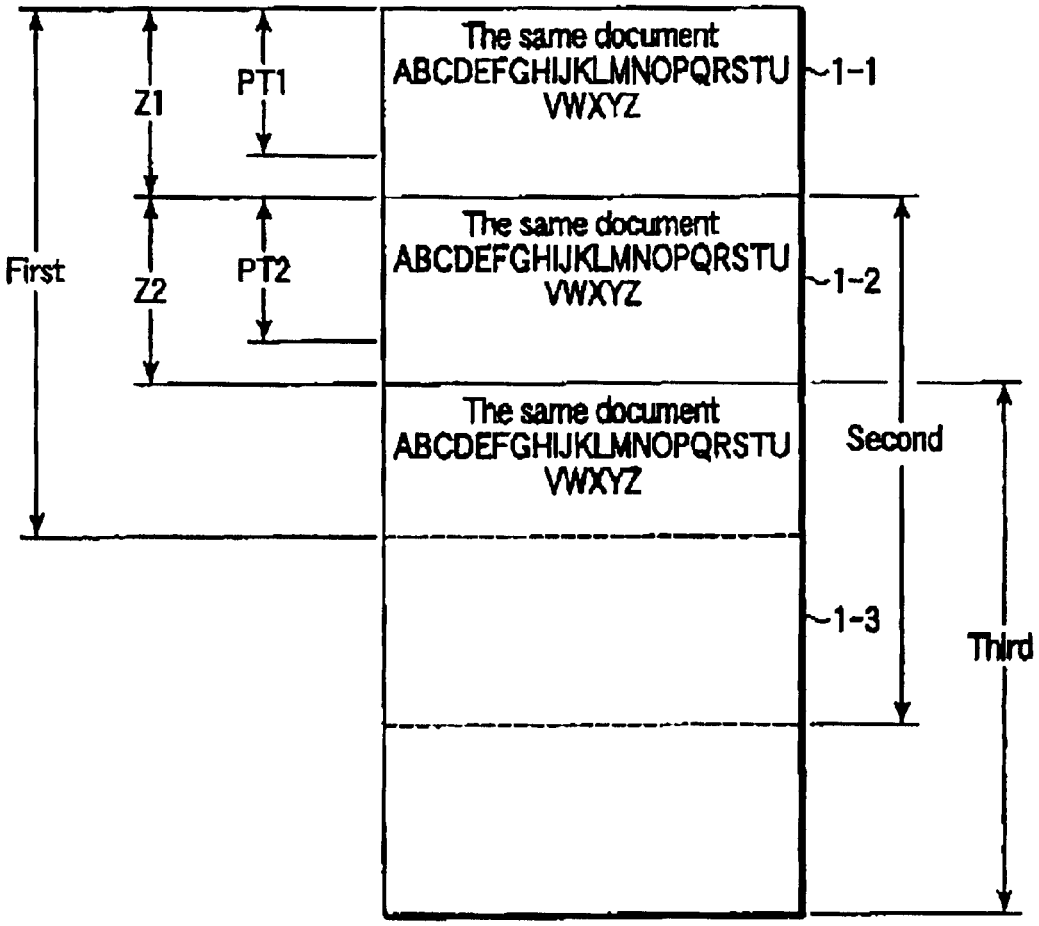
FIG. 6 is a view showing the relationship between image recording of each recording sheet and a quantity of displacement during overlap feeding in FIG. 5.

For example, the relationship between $PT_1$, $PT_2$ and $Z_1$, $Z_2$ when the three recording sheets 1-1, 1-2 and 1-3 are overlapped is as shown in FIG. 6.

Figure 7:
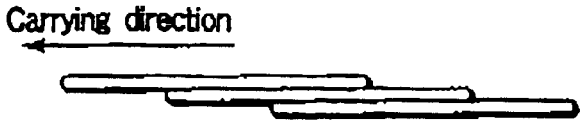
FIG. 7 is a view showing another example of overlap feeding of the recording sheets in the embodiment.

To feed the recording sheets 1 sequentially, each partly lying beneath another and partly lying as shown in FIG. 7, the change-over section 8 changes the orientation of each sheet 1 downwards. The control roller 6 controls the displacement of the sheet 1 from the front edge, in accordance with a distance from the rear edge of the image-recording area.

That is, when trying to record images on n recording sheets 1 to each of distances $PB_1$, $PB_2$, . . . , $PB_n$ from the respective end sections, the displacement between the precedent recording sheet 1 and the following recording sheet 1 corresponds to each of the distances $Z_1$, ($>PB_1$), $Z_2$ ($>PB_2$), . . . , $Z_n$ ($>PB_n$).

Figure 8:
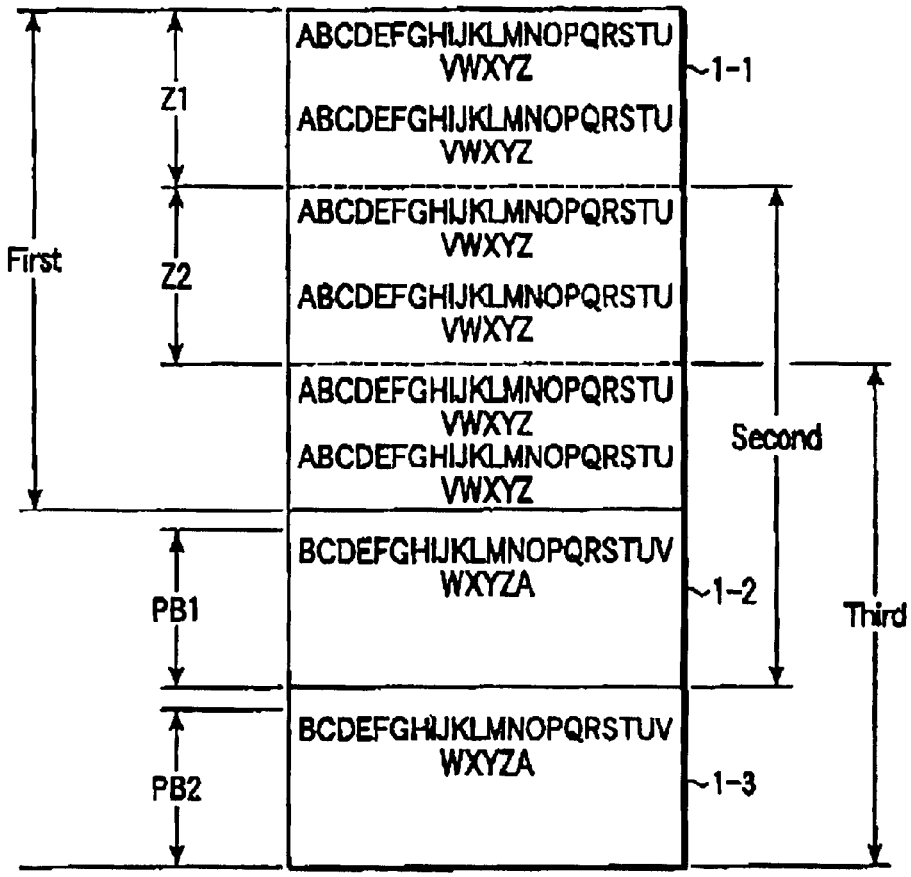
FIG. 8 is a view showing the relationship between image recording of each recording sheet and a quantity of displacement in overlap feeding in FIG. 7.

For example, the relationship between $PB_1$, $PB_2$ and $Z_1$, $Z_2$ when three recording sheets 1-1, 1-2, 1-3 are overlapped is as shown in FIG. 8.

Figure 9:
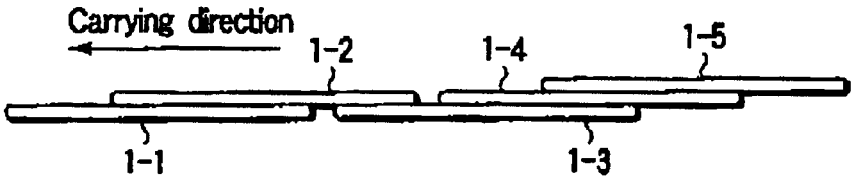
FIG. 9 is a view showing another example of overlap feeding of the recording sheets in the embodiment.

In addition, as shown in FIG. 9, by controlling changing of the direction of the change-over section 8 in accordance with each recording sheet 1, the recording sheet 1 can be positioned on or under the preceding recording sheet 1 without restraint. However, the image recording surface always faces up.

Changing of the direction by the change-over section 8 can be carried out in such a manner that the length $PT_h$ which is half of the recording sheet 1 to be precedently fed out is compared with the length PB of the image recording range from the rear end section of the recording sheet 1 to be subsequently fed out, the recording sheet 1 to be subsequently fed out is superimposed on the recording sheet 1 to be precedently fed out when $PT_n \leqq PB$, and the recording sheet 1 to be subsequently fed out is positioned under the recording sheet 1 to be precedently fed out when $PT_n > PB$.

In this manner, in the case of performing image recording with respect to a plurality of recording sheets 1, the amount of overlap is determined based on the relationship with the image recording range relative to each recording sheet 1, the respective recording sheets 1 are sequentially positioned in accordance with this quantity, image recording is carried out and the recording sheets 1 are ejected. For example, the image recording range relative to the recording sheet 1 is approximately half of the sheet, the subsequent recording sheet 1 can be superimposed by an amount which is approximately half of the preceding recording sheet 1. In this manner, since three or four recording sheets can be overlapped and carried in this manner, the throughput of carrying of the recording sheets can be sufficiently improved.

FIG. 9 shows that the second recording sheet 1-2 is superimposed on the first recording sheet 1-1, the third recording sheet 1-3 is positioned under the second recording sheet 1-2, the fourth recording sheet 1-4 is superimposed on the third recording sheet 1-3, the fifth recording sheet 1-5 is superimposed on the fourth recording sheet 1-4 and they are carried in order to perform image recording.

Since the third recording sheet 1-3 is positioned under the second recording sheet 1-2, when the respective recording sheets 1-1 to 1-5 having images already recorded thereon are ejected to the ejection tray and the recording sheets are superimposed as they are, the order of superimposition of the recording sheets is different from the order of image recording.

Figure 10:
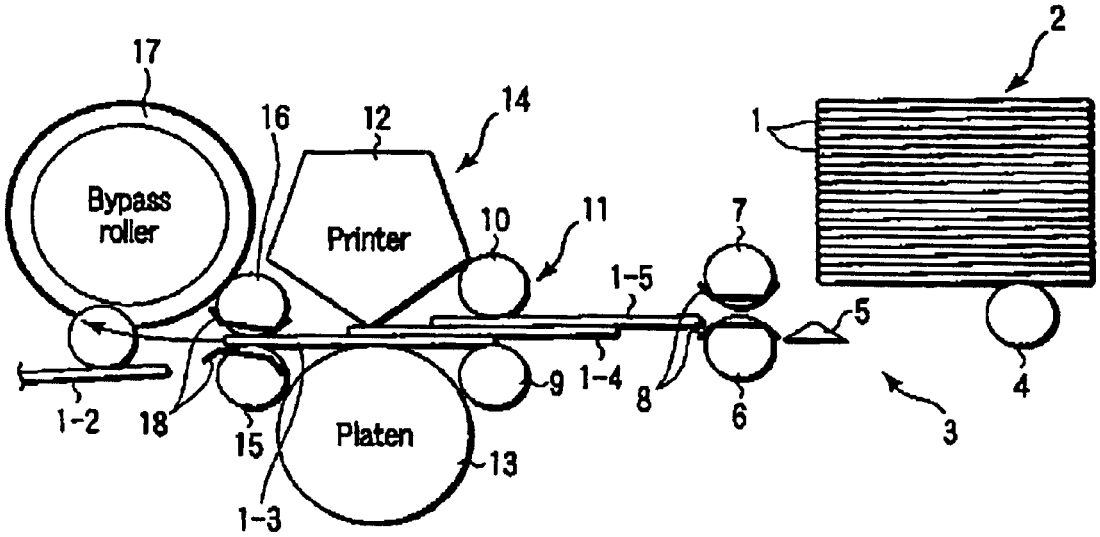
FIG. 10 is a view for illustrating the operation of a path change-over section and a bypass roller in the embodiment.

Thus, as shown in FIG. 10, when the third recording sheet 1-3 passes between the ejection roller 15 and the idle roller 16, the path change-over section 18 is changed to feed the recording sheets 1-4 and 1-5 to the bypass roller 17, and they are caused to bypass. Therefore, the recording sheets 1-3, 1-4 and 1-5 can be sequentially superimposed on the recording sheet 1-2 and ejected. Consequently, the five recording sheets 1-1 to 1-5 ejected onto the ejection tray are superimposed in the order equal to that of image recording, and the recording sheets cannot be in the wrong order.

Additionally, when the same image recording is performed with respect to a plurality of recording sheets 1, there is no problem even if the order of image recording is different from that of the recording sheets superimposed in the ejection section. In such a case, the operations of the path change-over section 18 and the bypass roller 17 are stopped, and a plurality of the recording sheets 1 fed out from the image recording section 14 are ejected as they are. In this case, since bypass of the recording sheets is not carried out, the recording sheets can be rapidly ejected.

Further, when a non-contact type printer such as an ink jet printer is used as the printer 12, a change in distance between the printer 12 and the image recording surface of the recording sheet 1 due to overlap of a plurality of the recording sheets becomes a problem.

For example, when the ink jet printer is used as the printer 12, the ink is scattered with respect to the recording sheet 1, thereby performing image recording. At this moment, the distance of the ink discharged from the printer and scattered onto the image recording surface of the recording sheet 1 varies due to the overlapped state of the recording sheet 1.

Figure 11:
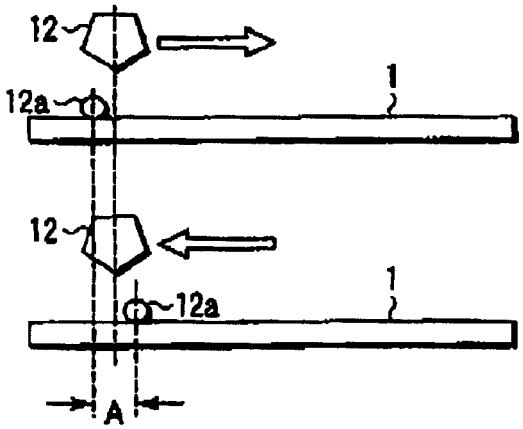
FIG. 11 is a view for illustrating an example of the relationship of the distance between a printer and an image recording surface and displacement of recording positions between an outward route and an inward route in the embodiment.

As shown in FIG. 11, when an image is recorded on the image recording surface of only one recording sheet 1, the distance between the printer 12 and the image recording surface of the recording sheet 1 becomes relatively large.

When the printer 12 is a serial printer and it records an image while reciprocating in the main scanning direction, the position when the ink 12*a* discharged from the printer 12 reaches the image recording surface of the recording sheet 1 and the position of the printer 12 at that moment are displaced by a length of A/2 in the outward route and the inward route. Therefore, as the recording position, the displacement of A is generated in the outward route and the inward route. This displacement is corrected by previously setting a reciprocating recording correction value. That is, adjustment is carried out so as to avoid the displacement in recording position between the outward route and the inward route.

Figure 12:
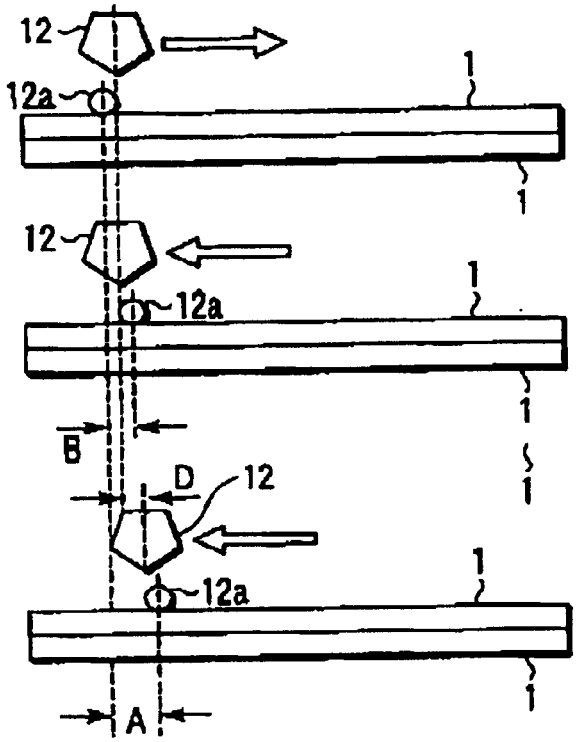
FIG. 12 is a view for illustrating an example of the relationship of the distance between a printer and an image recording surface and displacement of recording positions between an outward route and an inward route in the embodiment.

As shown in FIG. 12, when an image is recorded on the image recording surface having the two recording sheets 1 superimposed, the distance between the printer 12 and the image recording surface of the recording sheet 1 becomes shorter than that illustrated in FIG. 11 by a quantity corresponding to the thickness of the recording sheet 1. That is, the gap along which the ink is scattered becomes small, and the time required for the ink to reach the image recording surface after start of discharge is shortened.

At this moment, the position when the ink 12 discharged from the printer 12 reaches the image recording surface of the recording sheet 1 and the position of the printer 12 at that moment are displaced by a distance of B/2 in the outward route and the inward route. Therefore, as the recording position, the displacement of B is generated in the outward route and the inward route. However, the distance B is smaller than the distance A.

Therefore, a value D is calculated based on D=A−B, the discharge start timing of the ink from the printer 12 is adjusted by using the value D when performing image recording with the two recording sheets 1 superimposed. That is, the preset reciprocating recording correction value is reduced based on the value D, and the discharge timing of the ink in the outward route is delayed.

As a result, the recording positions in the outward route and the inward route coincide with each other even if an image is recorded on the two superimposed recording sheets.

Figure 13:
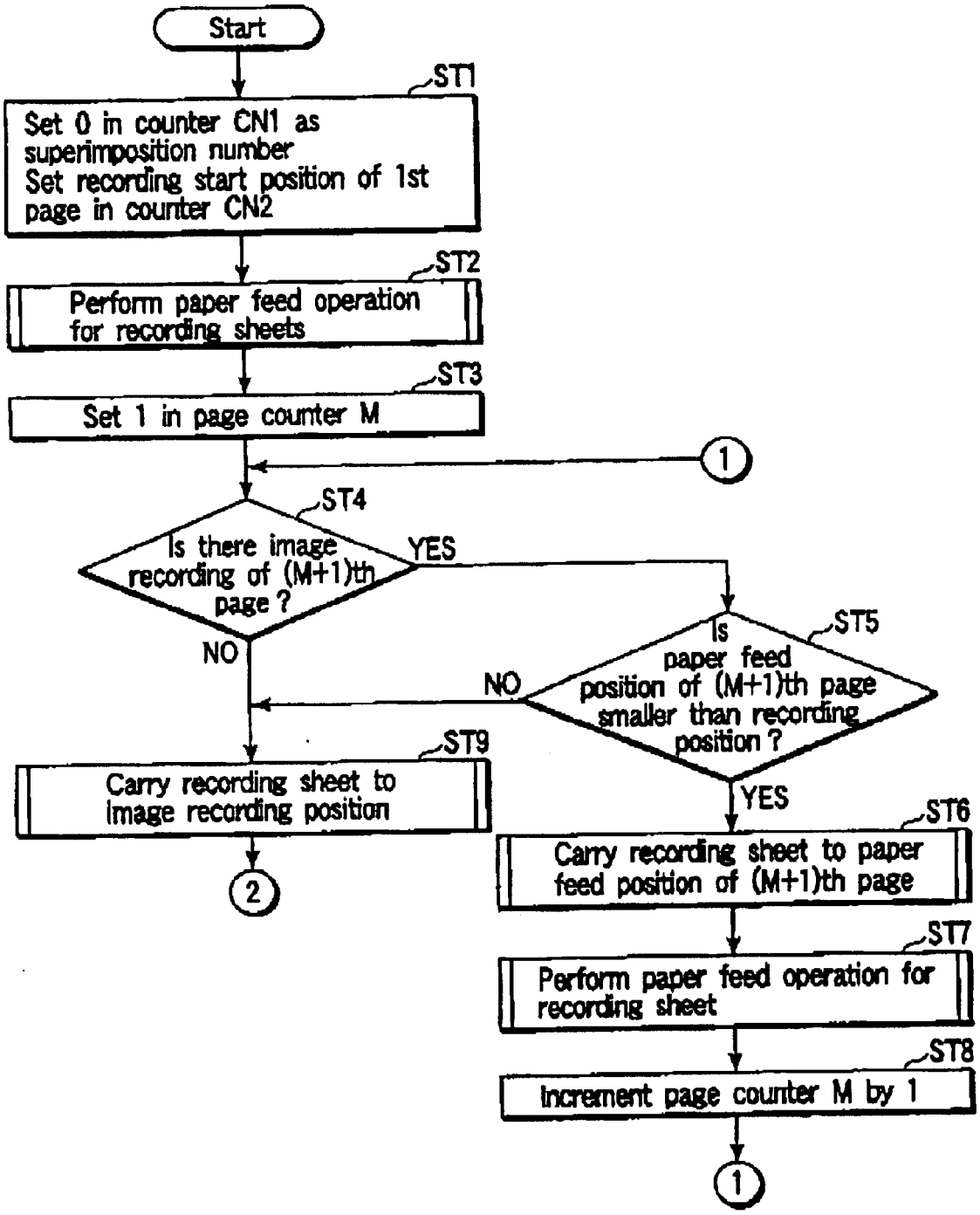
FIG. 13 is a flowchart showing image recording control by a CPU in the embodiment.
Figure 14:
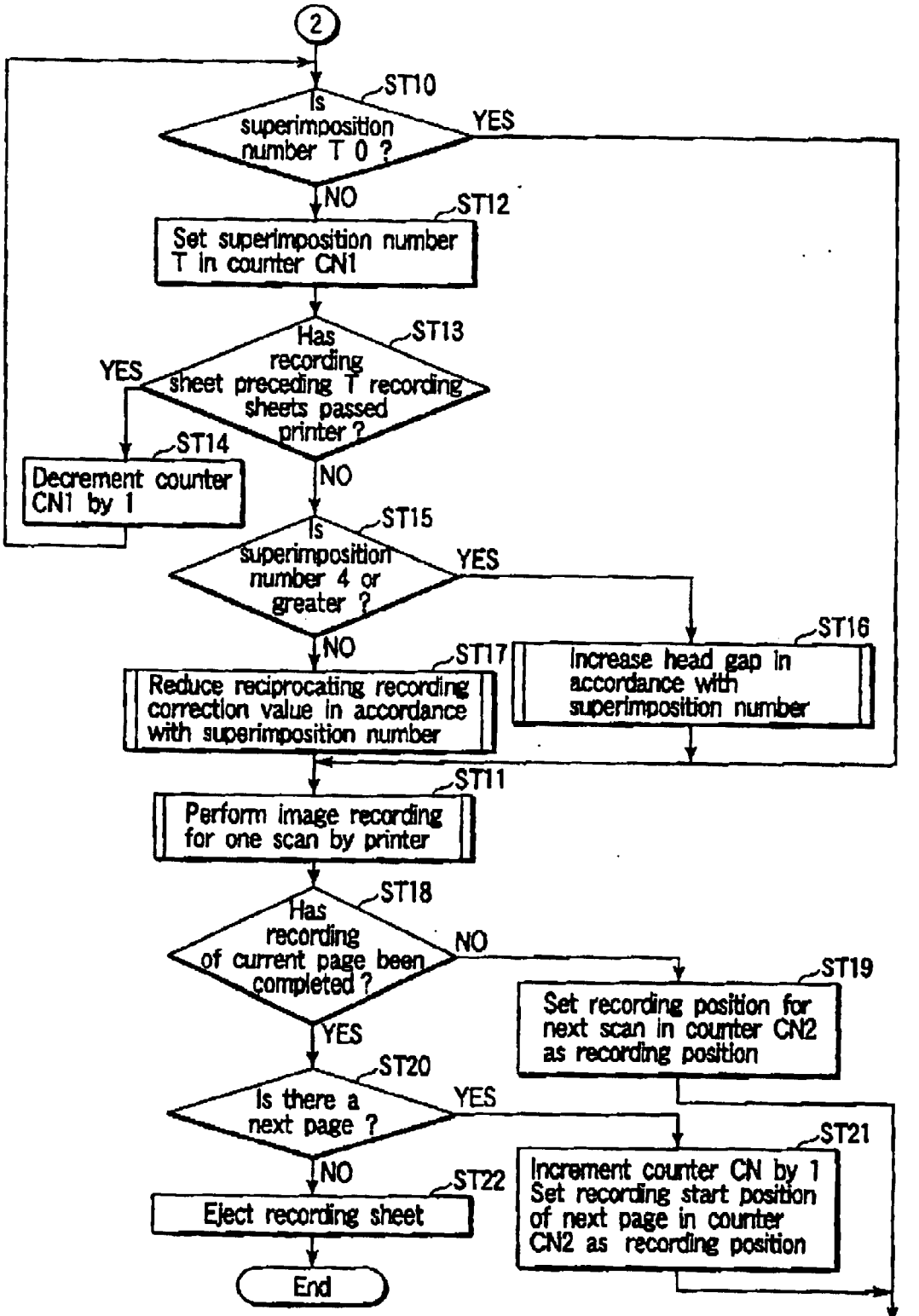
FIG. 14 is a flowchart showing image recording control by the CPU in the embodiment.

FIGS. 13 and 14 are flowcharts showing the image recording control by the CPU 21.

When image recording is started, the CPU 21 sets 0 in counter $CN_1$ in the RAM 23 as the number of superimposed sheets at step ST1. Furthermore, the recording start position of the first page is set in counter $CN_2$ in the RAM 23. The paper feed operation for the recording sheet 1 is performed at step ST2, and 1 is set in page counter M in the RAM 23 at step ST3.

Then, the CPU 21 judges whether there is image recording of the (M+1)th page at step ST4, and it compares the paper feed position and the recording position in the (M+1) th page if there is image recording at step ST5.

If the paper feed position of the (M+1)th page is smaller than the recording position, the recording sheet 1 is carried to the paper feed position of the (M+1)th page at step ST6, the paper feed operation for the recording sheet is performed at step ST7, and the page counter M is incremented by 1 at step ST8. Then, the processing returns to step ST4.

Furthermore, when it is determined that there is no image recording of the (M+1)th page at step ST4, or when it is determined that the paper feed position of the (M+1)th page is equal to or above the recording position at step ST5, the CPU 21 carries the recording sheet 1 to the image recording position at step ST9.

Subsequently, the CPU 21 judges whether the set superimposition number T is 0 at step ST10. If 0, it determines that only one recording sheet 1 is carried, and performs image recording for one scan with respect to the recording sheet 1 by the printer 12 at step ST11.

Moreover, when it is determined that the set superimposition number T is not 0 at step ST10, the CPU 21 then sets the set superimposition number T in counter $CN_1$ at step ST12. At step ST13, a judgment is made upon whether the recording sheet 1 which precedes the T recording sheets has passed the printer 12.

When it is determined that the recording sheet 1 which precedes the T recording sheets has passed the printer 12, the CPU 21 decrements counter $CN_1$ by 1 at step ST14, and the processing returns to step ST10.

In addition, when it is determined that the recording sheet 1 which precedes the T recording sheets has not passed the printer 12, the CPU 21 then judges whether the superimposition number T is greater than or equal to 4 at step ST15. When it is determined that the superimposition number T is greater than or equal to 4, the printer 12 is moved upward and the head gap itself is increased at step ST16. Additionally, when it is determined that the superimposition number T is less than or equal to 3, the CPU 21 performs the adjustment to reduce the reciprocating recording correction value in accordance with the superimposition number at step ST17.

After carrying out this adjustment, image recording for one scan is conducted with respect to the recording sheet 1 by the printer 12 at step ST11.

Then, the CPU 21 judges whether recording of the current page has been completed at step ST18. If it is yet to be completed, the recording position of the next scan is set in counter $CN_2$ as the recording position at step ST19. Thereafter, the processing returns to step ST4.

Additionally, if recording of the current page has been completed, the CPU 21 judges whether there is a next page at step ST20. If there is a next page, counter $CN_1$ is incremented by 1 at step ST21. Further, the recording start position of the next page is set in counter $CN_2$ as the recording position. Then, the processing returns to step ST4.

If there is no next page, the CPU 21 ejects the recording sheet 1 and terminates the sequence of image recording control at step ST22.

In this manner, the N recording sheets are displaced from the end of each preceding recording sheet by a predetermined distance in accordance with the set superimposition number, or they are displaced from the rear end of each preceding recording sheet by a predetermined distance, and they are superimposed and carried.

If the number of superimposition T is greater than or equal to 4, the printer 12 is moved upward, and the head gap itself between the printer 12 and the platen 13 is increased. Further, if the number of superimposition T is less than or equal to 3, the adjustment to reduce the reciprocating recording correction number is carried out in accordance with the number of superimposition without moving the printer 12.

By performing such a control, the image can be accurately recorded on the recording sheet 1 in the reciprocating recording mode by the printer 12 even if the number of the recording sheet is one or a plurality of recording sheets are superimposed.

Figure 15:
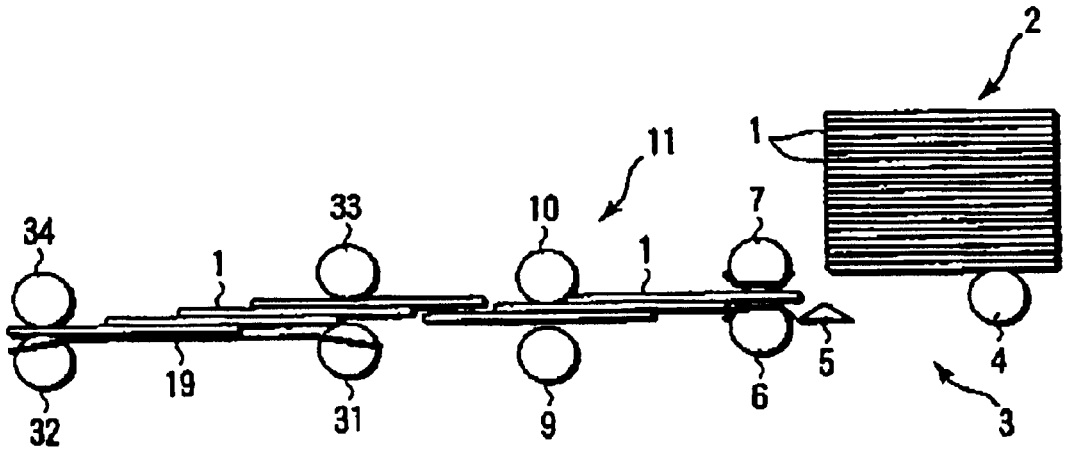
FIG. 15 is a partial structural view showing another embodiment according to the present invention.

In this embodiment, the image recording section 14 is provided immediately after the carrying section 11 that comprises the feed roller 9 and idle roller 10. Nonetheless, a sub-tray 19 may be provided after the carrying section 11 as illustrated in FIG. 15. The sub-tray 19 can function as a holding section for temporarily holding a plurality of recording sheets 1 that overlap, each displaced from another.

By doing so, after temporarily holding the recording sheets 1 superimposed in the sub-tray 19, they can be fed out to the image recording section 14 by the feed rollers 31 and 32 and the idle rollers 33 and 34 with a predetermined timing.

Incidentally, it is desirable to makes the length of the sub-tray 19 shorter than the length of the recording sheet of the maximum size on which an image can be recorded by the printer 12.

It is to be noted that the adjustment to increase the head gap itself is conducted when the superimposition number of the recording sheets is greater than or equal to four in this embodiment but the superimposition number is not restricted to four.

Furthermore, although description has been given as to sequential feeding of the recording sheets superimposed and accommodated in the accommodation section from the lowermost sheet in this embodiment, the present invention is not restricted thereto. The recording sheets superimposed and accommodated in the accommodation section may be fed out in order from the uppermost sheet. In this case, the accommodation section is positioned under the feed-out roller 4.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image recording apparatus comprising;

an accommodation section which accommodates therein a plurality of recording sheets in a superimposed state;

a feed-out mechanism which displaces each of n recording sheets by a distance corresponding to lengths Z1, Z2, . . . , Zn respectively and feeds out the recording sheets from the accommodation section in a displaced superimposed state;

a carrying section which carries the n recording sheets fed out by the feed-out mechanism in the displaced superimposed state; and an image recording section which records an image on each of the n recording sheets carried in the displaced superimposed state within a respective range of the lengths Z1, Z2, . . . , Zn;

wherein the feed-out mechanism includes a change-over section which positions a subsequently fed out recording sheet to be one of on top of and under a precedently fed out recording sheet; and wherein the change-over section comprises a control section which compares a length $PT_h$ which is half of the length of the precedently fed out recording sheet with a length PB of an image recording range of the subsequently fed out recording sheet measured from a rear end of the subsequently fed out recording sheet, and which controls the change-over section to position the subsequently fed out recording sheet on top of the precedently fed out recording sheet when $PT_h \leqq PB$ and to position the subsequently fed out recording sheet under the precedently fed out recording sheet when $PT_h > PB$.

2. An image recording apparatus according to claim 1, wherein the feed-out mechanism includes a roller which comes into contact with a recording sheet accommodated in the accommodation section on a non-image-recording surface of the recording sheet and feeds out the recording sheet.

3. An image recording apparatus according to claim 1, wherein the feed-out mechanism includes a roller which comes into contact with a recording sheet accommodated in the accommodation section on a rear side of the recording sheet in a feed-out direction on a non-image-recording surface of the recording sheet and feeds out the recording sheet.

4. An image recording apparatus according to claim 1, wherein the image recording section comprises a non-contact image recording section which projects a recording material onto the recording sheet to record an image, and which adjusts a discharge start timing of the recording material in accordance with a change in a projection distance of the recording material due to positioning of the recording sheets carried in the displaced superimposed state.

5. An image recording apparatus according to claim 1, wherein the carrying section includes a holding section which temporarily holds recording sheets fed out by the feed-out mechanism in the displaced superimposed state.

6. An image recording apparatus comprising:

an accommodation section which accommodates therein a plurality of recording sheets in a superimposed state;

a feed-out mechanism which displaces each of n recording sheets by a distance corresponding to lengths Z1, Z2, . . . , Zn respectively and feeds out the recording sheets from the accommodation section in a displaced superimposed state, wherein the feed-out mechanism includes a change-over section which positions a subsequently fed out recording sheet to be one of on top of and under a precedently fed out recording sheet;

a carrying section which carries the n recording sheets fed out by the feed-out mechanism in the displaced superimposed state;

an image recording section which records an image on each of the n recording sheet carried in the displaced superimposed state within a respective range of the lengths Z1, Z2, . . . , Zn; and a change section which changes the displaced superimposed state such that the recording sheets to be ejected are positioned in an order of image recording by the image recording section.

7. An image recording apparatus according to claim 6, wherein the change section does not operate when a same image is recorded on the n recording sheets.

* * * * *